US009277797B2

(12) United States Patent
Chen

(10) Patent No.: US 9,277,797 B2
(45) Date of Patent: Mar. 8, 2016

(54) COSMETIC CONTAINER

(71) Applicant: Sin-Hsiung Chen, Tainan (TW)

(72) Inventor: Sin-Hsiung Chen, Tainan (TW)

( * ) Notice: Subject to any disclaimer, the term of this patent is extended or adjusted under 35 U.S.C. 154(b) by 0 days.

(21) Appl. No.: 14/455,459

(22) Filed: Aug. 8, 2014

(65) Prior Publication Data

US 2016/0037890 A1 Feb. 11, 2016

(51) Int. Cl.

*B65D 55/02* (2006.01)
*A45D 34/00* (2006.01)
*B05B 11/00* (2006.01)

(52) U.S. Cl.

CPC ..... *A45D 34/00* (2013.01); *B05B 11/0037* (2013.01); *B05B 11/3001* (2013.01); *B05B 11/3043* (2013.01); *B05B 11/0027* (2013.01)

(58) Field of Classification Search

CPC ..... B05B 11/0027; B05B 11/0037
USPC ..... 222/160, 167, 182
See application file for complete search history.

(56) References Cited

U.S. PATENT DOCUMENTS 4,620,646 A * 11/1986 Crapser ..... B05B 11/3047 222/153.11
5,499,747 A 3/1996 Quennessen
6,375,045 B1 * 4/2002 Ki ..... B65D 83/0033 222/256
8,308,029 B2 * 11/2012 Ki ..... B05B 11/0027 222/153.13
D696,962 S * 1/2014 Chen ..... D9/688
8,714,412 B2 * 5/2014 Benigni ..... 222/153.11
8,851,330 B1 * 10/2014 Chen ..... B05B 11/0032 222/160
2007/0075102 A1 * 4/2007 Moore ..... B05B 11/0032 222/519

FOREIGN PATENT DOCUMENTS

FR 2489116 A1 3/1982
FR 2686002 A3 7/1993
WO WO2008/010640 A1 1/2008

OTHER PUBLICATIONS

Machine Translation of FR2489116, 6pg.*
European Search Report—EP 14 18 0244—Nov. 28, 2014.

* cited by examiner

*Primary Examiner* — Daniel R Shearer
(74) *Attorney, Agent, or Firm* — Shimokaji IP

(57) ABSTRACT

A cosmetic container has a first sleeve, a driving assembly, a bottle and a second sleeve. The driving assembly is mounted in the first sleeve and has a first rotating tube, a seat and a second rotating tube. The seat is moveably mounted in the first rotating tube. The second rotating tube is rotatably mounted around the first rotating tube. The bottle is mounted in the seat of the driving assembly and has a vacuum valve and an outlet. The second sleeve is coactively mounted on the second rotating tube. The first sleeve is rotated by the driving assembly to drive the bottle to move up and down. Therefore, the cosmetic container can be operated conveniently. The piston can push out the cosmetic product in the body effectively. Therefore, quantity of cosmetic product remaining on an inner surface of the body is decreased.

8 Claims, 7 Drawing Sheets

COSMETIC CONTAINER

BACKGROUND OF THE INVENTION

1. Field of the Invention

The present invention relates to a container, and more particularly to a cosmetic container that contains a cosmetic product and is easy to operate.

2. Description of Related Art

A conventional cosmetic container has a body, a press-type nozzle, and a pipe. The body has a chamber to contain a fluid-type cosmetic product. An opening is formed in the body and is in communication with the chamber of the body. The press-type nozzle is mounted on the opening of the body. The pipe is mounted on the press-type nozzle and is located in the chamber of the body. The press-type nozzle can be pressed and the fluid-type cosmetic product in the body is drawn out of the press-type nozzle via the pipe. Furthermore, a cap is mounted on the press-type nozzle to avoid the fluid-type cosmetic product from exposure to air and deteriorating.

The operation of the cosmetic container requires removing and retrieving the cap, but the cap is prone to loss. Therefore, the operation of the cosmetic container is inconvenient. If the cap is lost, the fluid-type cosmetic product in the body is not properly sealed and deteriorates easily. When the fluid-type cosmetic product is dispensed through the pipe, a part of the fluid-type cosmetic product easily remains in an inner surface of the body and is hard to be fully dispensed for use.

To overcome the shortcomings, the present invention tends to provide a cosmetic container to mitigate or obviate the aforementioned problems.

SUMMARY OF THE INVENTION

The main objective of the invention is to provide a cosmetic container that is easy to operate.

The cosmetic container has a first sleeve, a driving assembly, a bottle and a second sleeve. The driving assembly is mounted in the first sleeve and has a first rotating tube, a seat and a second rotating tube. The first rotating tube is coactively mounted in the first sleeve and has an outer surface, an annular flange and multiple chutes. The annular flange is formed on the outer surface of the first rotating tube. The chutes are formed through the outer surface of the first rotating tube. Each chute has a slanting section and a transverse section connected to a top end of the slanting section. The seat is moveably mounted in the first rotating tube and has multiple protrusions respectively protruding into the chutes of the first rotating tube. The second rotating tube is rotatably mounted around the first rotating tube and has an inner surface, an annular groove, multiple longitudinal grooves, and a positioning ring. The annular groove is formed in the inner surface and connected to the annular flange of the first rotating tube. The longitudinal grooves are formed in the inner surface and the protrusions of the seat respectively protrude into the longitudinal grooves. The positioning ring is formed on the inner surface and an internal diameter of the positioning ring is smaller than an internal diameter of the second rotating tube. The positioning ring has a positioning surface formed on a top surface of the positioning ring.

The bottle is mounted in the seat of the driving assembly and has a body, a chamber, a piston, a vacuum valve, a cap and an outlet. The body is mounted in the seat of the driving assembly and an outer diameter of the body is smaller than the internal diameter of the positioning ring. The chamber is formed in the body. The piston is mounted in the body and is moveably located in the chamber. The vacuum valve is mounted on the body. The cap is mounted on the vacuum valve and a bottom surface of the cap faces the positioning surface of the positioning ring. The outlet is formed in the cap and sunk in the second rotating tube. The second sleeve is coactively mounted on the second rotating tube of the driving assembly.

The first sleeve is rotated to drive the first rotating tube. The protrusions of the seat move along the chutes of the first rotating tube and the longitudinal grooves of the second rotating tube, and then the seat drives the bottle to move upward and downward. Therefore, the cosmetic container can be operated conveniently. When the bottle moves upward, the cap of the bottle protrudes out of the second rotating tube, and then users can press the cap for driving the vacuum valve to generate a vacuum suction. The piston moves upward to push out a cosmetic product in the body by the vacuum suction. So the cosmetic product stored in the body is easy to be dispensed. When the bottle moves downward, the cap is sunk in the second rotating tube and the outlet is closed by the second rotating tube. So the cosmetic product in the body is stored in a proper condition.

The piston can push out and dispense the cosmetic product in the body effectively. Therefore, the quantity of the cosmetic product remaining in an inner surface of the body is decreased.

The outer diameter of the body is smaller than the internal diameter of the positioning ring. Therefore, the bottle is easy to be changed for replacement.

Other objects, advantages and novel features of the invention will become more apparent from the following detailed description when taken in conjunction with the accompanying drawings.

DETAILED DESCRIPTION OF PREFERRED EMBODIMENT

Figure 1:
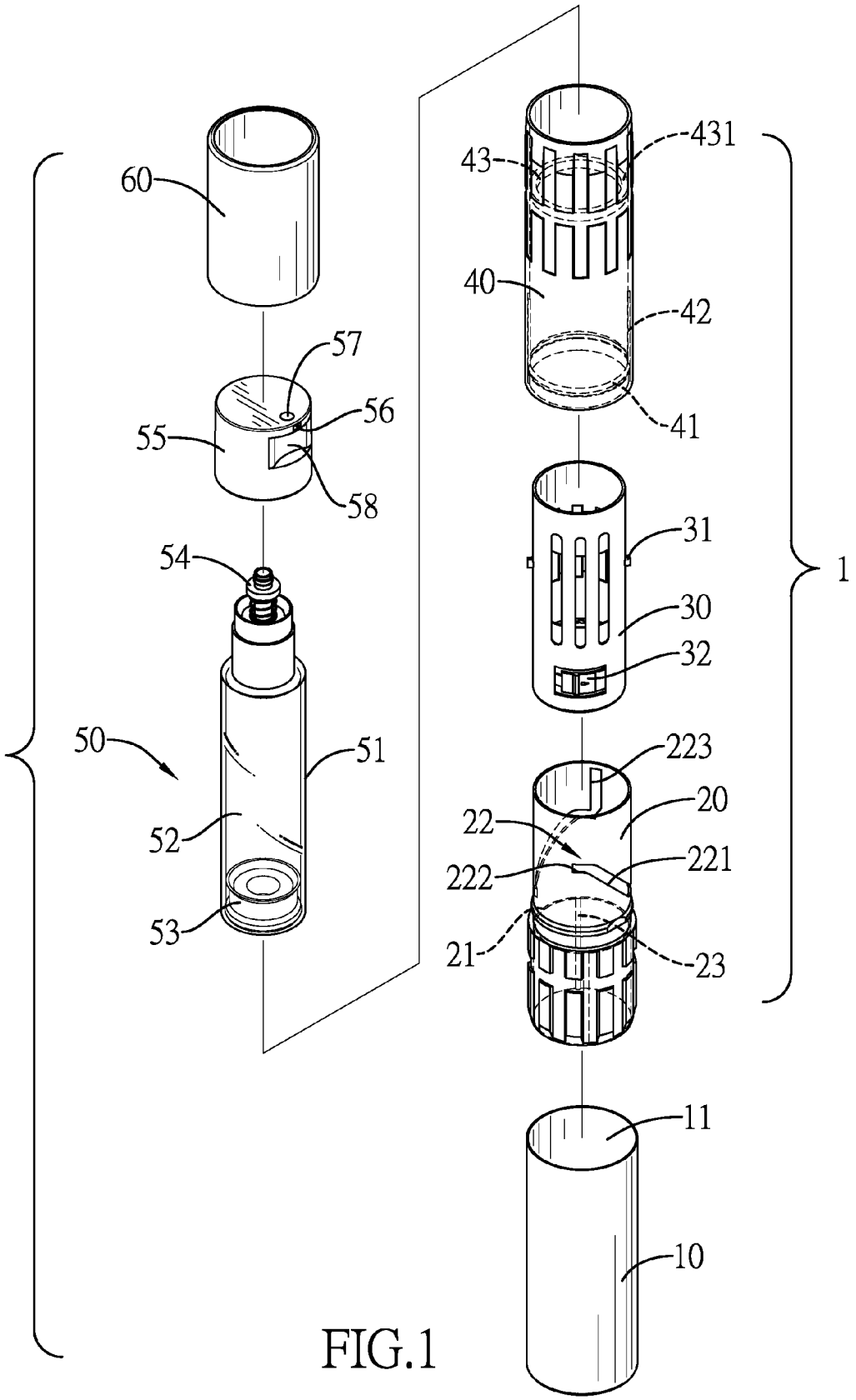
FIG. 1 is an exploded perspective view of a cosmetic container in accordance with the present invention.
Figure 2:
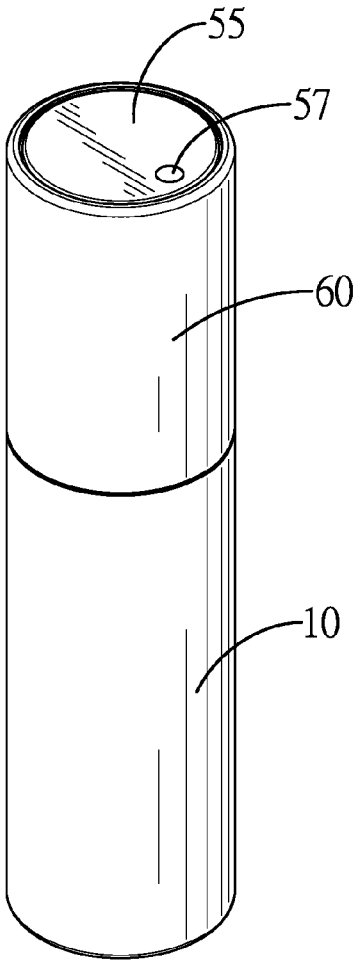
FIG. 2 is a perspective view of the cosmetic container in FIG. 1.
Figure 4:
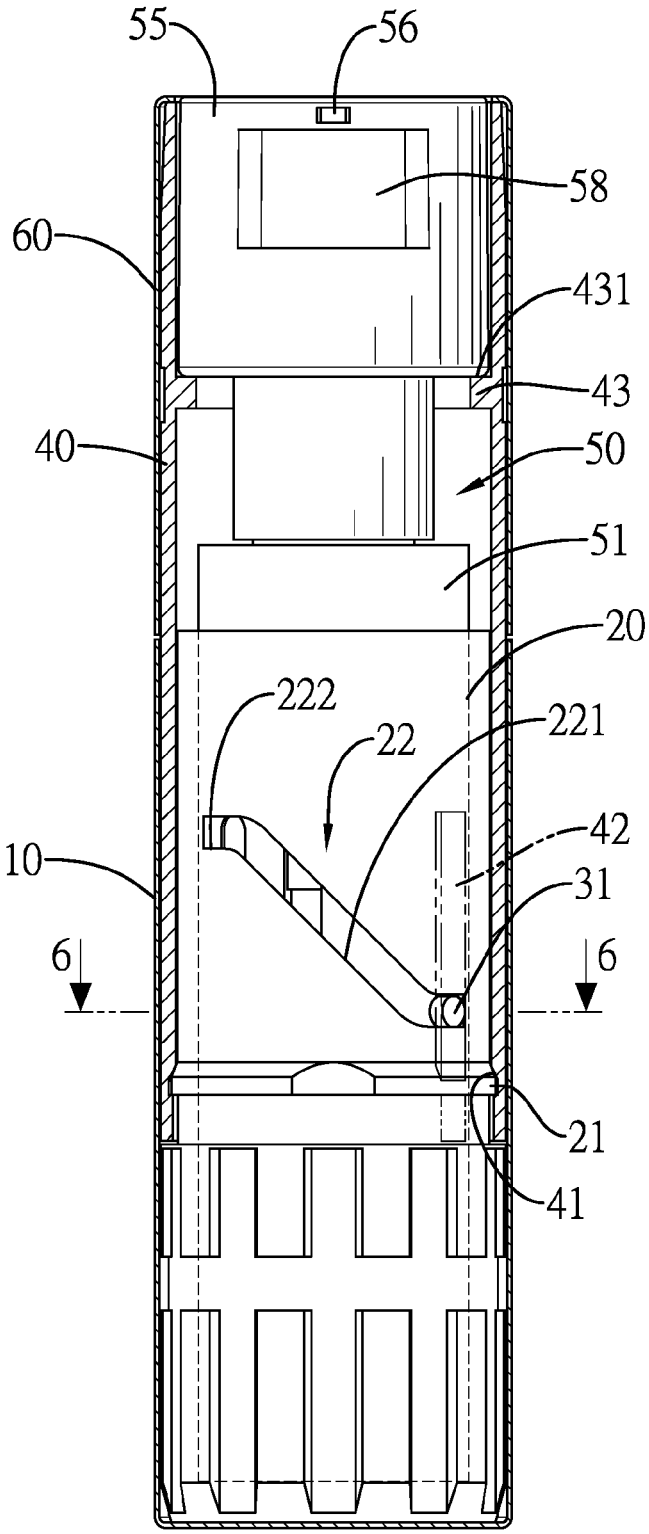
FIG. 4 is a side view in partial section of the cosmetic container in FIG. 2.

With reference to FIGS. 1, 2 and 4, a cosmetic container in accordance with the present invention comprises a first sleeve 10, a driving assembly 1, a bottle 50 and a second sleeve 60.

The first sleeve 10 has a space 11 and an opening. The space 11 is formed in the first sleeve 10. The opening is formed in a top of the first sleeve 10 and is in communication with the space 11.

The driving assembly 1 is mounted in the first sleeve 10 and has a first rotating tube 20, a seat 30 and a second rotating tube 40. The first rotating tube 20 is coactively mounted in the first sleeve 10 and is located in the space 11 of the first sleeve 10.

The first rotating tube 20 has an outer surface, an annular flange 21 and multiple chutes 22. The annular flange 21 is formed on the outer surface of the first rotating tube 10. The chutes 22 are formed through the outer surface of the first rotating tube 10. Each chute 22 has a slanting section 221 and a transverse section 222 connected to a top end of the slanting section 221. One of the chutes 22 of the first rotating tube 20 has a longitudinal section 223 connected to the transverse section 222 of said chute 22. The seat 30 is moveably mounted in the first rotating tube 20 and has multiple protrusions 31. The protrusions 31 respectively protrude into the chutes 22 of the first rotating tube 20. The second rotating tube 40 is rotatably mounted around the first rotating tube 20 and has an inner surface, an annular groove 41, multiple longitudinal grooves 42, and a positioning ring 43. The annular groove 41 is formed in the inner surface of the second rotating tube 40 and is connected to the annular flange 21 of the first rotating tube 20. The longitudinal grooves 42 are formed in the inner surface of the second rotating tube 40 and the protrusions 31 of the seat 30 respectively protrude into the longitudinal grooves 42. The positioning ring 43 is formed on the inner surface of the second rotating tube 40, and an internal diameter of the positioning ring 43 is smaller than an internal diameter of the second rotating tube 40. The positioning ring 43 has a positioning surface 431 formed on a top surface of the positioning ring 43.

The bottle 50 is mounted in the seat 30 of the driving assembly 1 and has a body 51, a chamber 52, a piston 53, a vacuum valve 54, a cap 55 and an outlet 56. The body 51 is mounted in the seat 30 of the driving assembly 1 and an outer diameter of the body 51 is smaller than the internal diameter of the positioning ring 43. The chamber 52 is formed in the body 51. The piston 53 is mounted in the body 51 and is moveably located in the chamber 52. The vacuum valve 54 is mounted on the body 51. The cap 55 is mounted on the vacuum valve 54 and a bottom surface of the cap 55 faces the positioning surface 431 of the positioning ring 43. The outlet 56 is formed in the cap 55 and is sunk in the second rotating tube 40.

The second sleeve 60 is coactively mounted on the second rotating tube 40 of the driving assembly 1.

With reference to FIG. 1, the first rotating tube 20 has multiple ribs 23 formed on an inner surface of the first rotating tube 20. The seat 30 has multiple positioning members 32 mounted on an outer surface of the seat 30, and the positioning members 32 are respectively connected to the ribs 23 of the first rotating tube 20. In addition, the bottle 50 has a mark 57. The mark 57 is mounted on a top surface of the cap 55 to indicate the outlet 56 of the bottle 50. The bottle 50 has a recess 58. The recess 58 is formed in an outer surface of the cap 55 and is located below the outlet 56.

Figure 6:
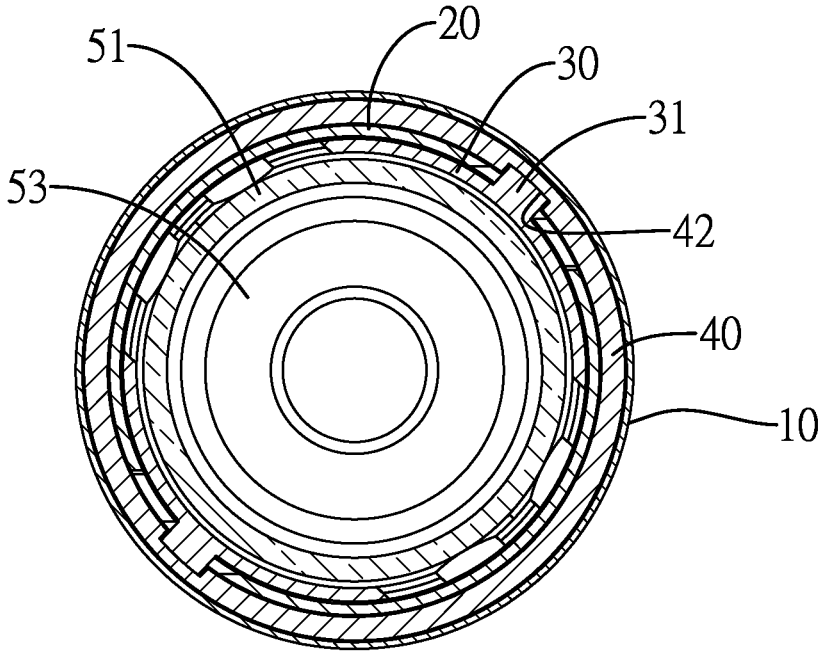
FIG. 6 is a top view in partial section of the cosmetic container along line 6-6 in FIG. 4.
Figure 7:
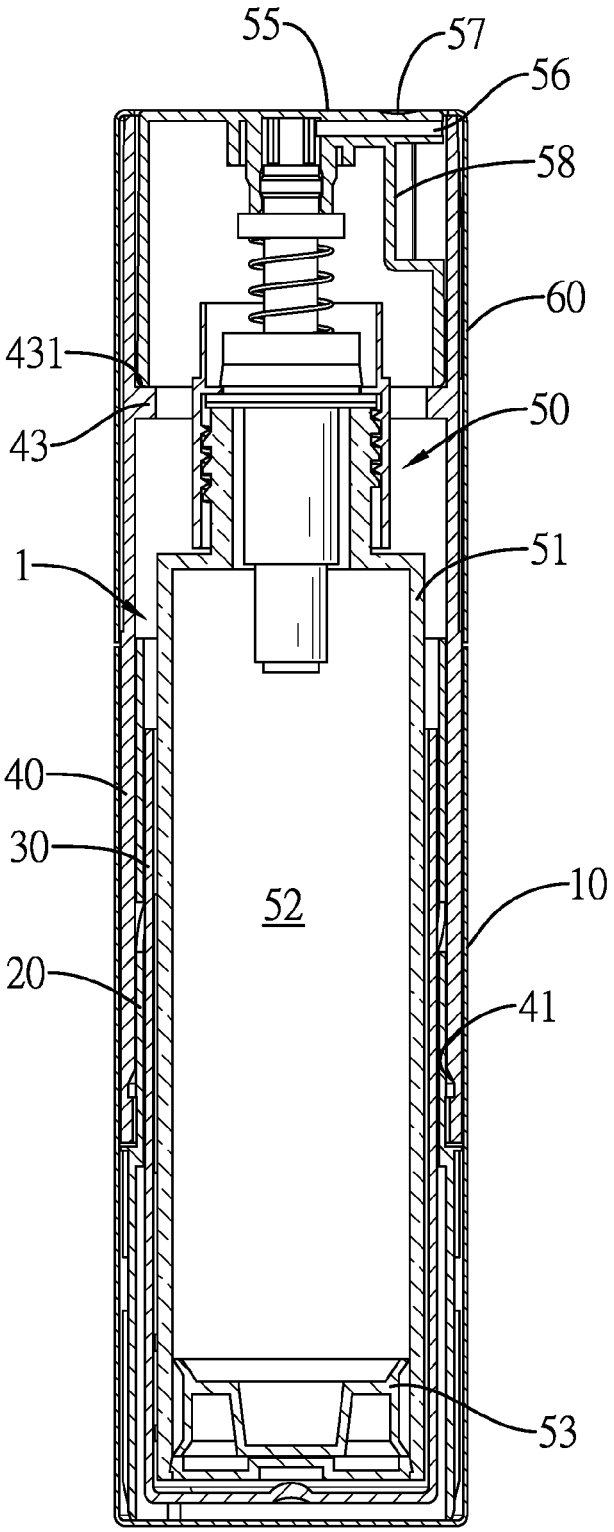
FIG. 7 is another side view in partial section of the cosmetic container in FIG. 2.

With reference to FIGS. 2, 4 and 6, when a cosmetic product stored in the body is not yet dispensed, the protrusions 31 of the seat 30 are located at a bottom end of the slanting section 221 of the chutes 22. The cap 55 of the bottle 50 is hidden in the second rotating tube 40, and the outlet 56 of the cap 55 is sunk in the second rotating tube 40.

Figure 3:
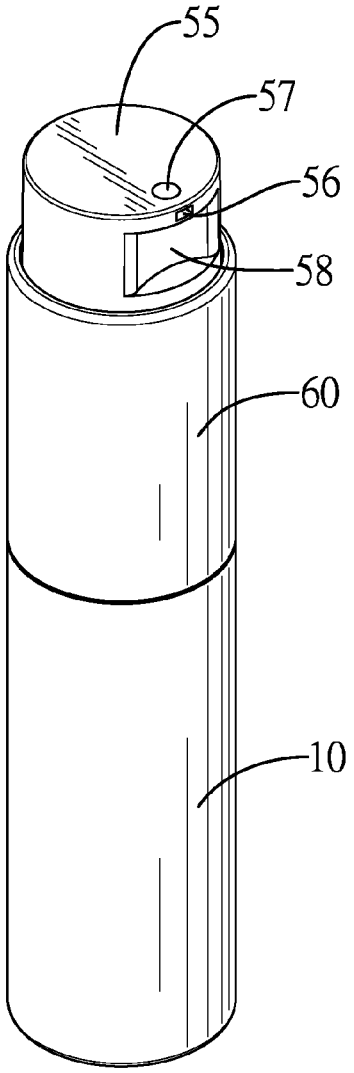
FIG. 3 is a perspective view of the cosmetic container in FIG. 1 showing a cap protruding out of a second sleeve of the cosmetic container.
Figure 5:
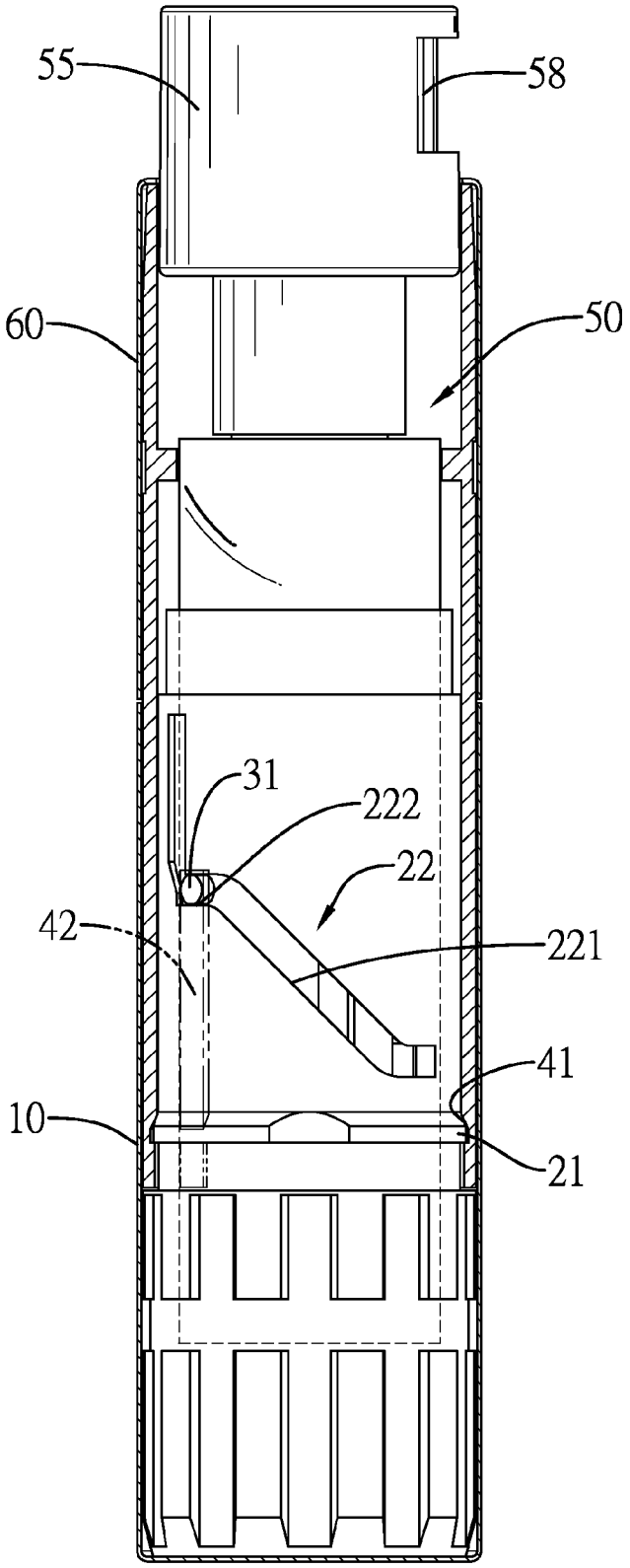
FIG. 5 is a side view in partial section of the cosmetic container in FIG. 3.
Figure 8:
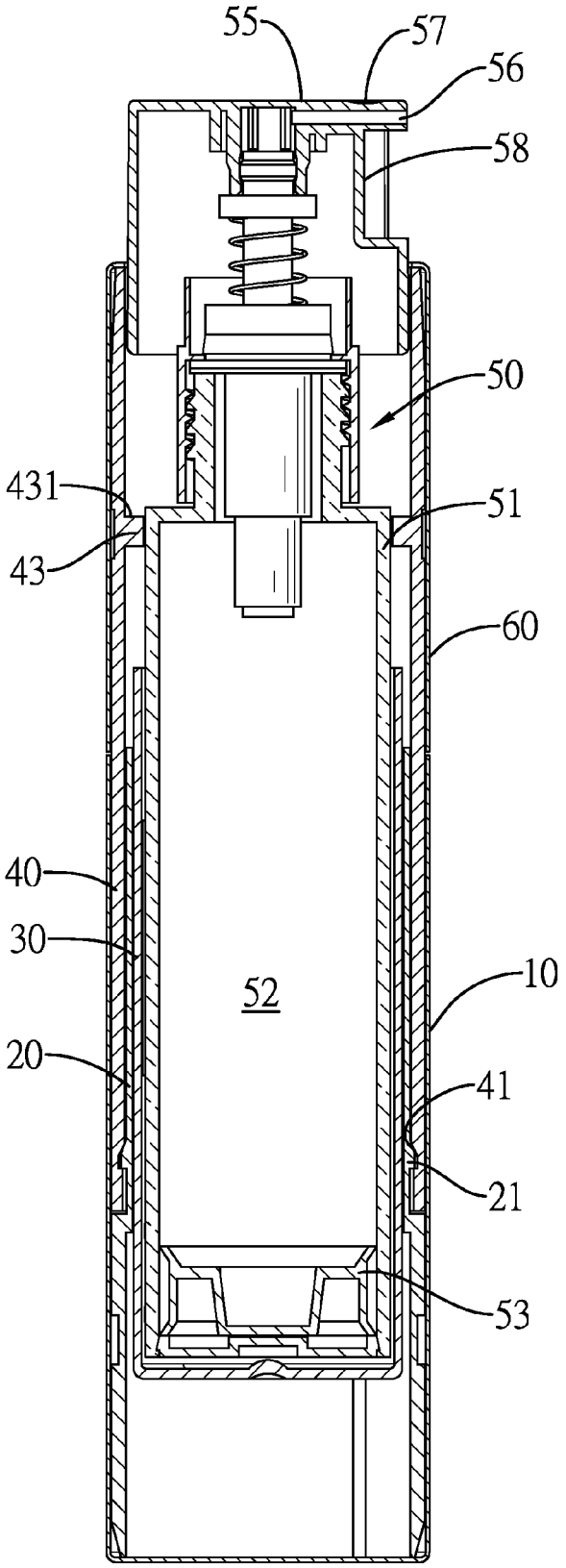
FIG. 8 is another side view in partial section of the cosmetic container in FIG. 3.

With reference to FIGS. 3, 5 and 8, when users want to dispense the cosmetic product out of the body 51, the first sleeve 10 is rotated to drive the first rotating tube 20 to rotate with the first sleeve 10. The protrusions 31 of the seat 30 move from the slanting sections 221 of the chutes 22 to the transverse sections 222 of the chutes 22. In the meanwhile, the protrusions 31 of the seat 30 move up along the longitudinal grooves 42 of the second rotating tube 40. The seat 30 moves upward relative to the first rotating tube 20 to drive the bottle 50 to move upward. Therefore, the cap 55 of the bottle 50 protrudes out the second rotating tube 40, and the outlet 56 of the cap 55 is exposed. Users can press the cap 55 to drive the vacuum valve 54 to generate a vacuum suction. Then, the piston 53 of the bottle 50 moves upward to push a cosmetic product stored in the body 51 out of the outlet 56. The piston 53 is connected to an inner surface of the body 51. Thus, the cosmetic product remaining on the inner surface of the body 51 is easy to be scraped out by the motion of the piston 53.

After users dispense the cosmetic product from the body 51, users can rotate the first sleeve 10 again, and the protrusions 31 of the seat 30 move from the transverse sections 222 of the chutes 22 to the bottom ends of the slanting sections 221 of the chutes 22. In the meanwhile, the protrusions 31 of the seat 30 move downward along the longitudinal grooves 42 of the second rotating tube 40. The seat 30 moves downward relative to the first rotating tube 20 to drive the bottle 50 to move downward. Therefore, the bottle 50 is hidden in the second rotating tube 40, and the outlet 56 of the cap 55 is sunk in the second rotating tube 40 to prevent air from flowing into the chamber 52 of the bottle 50. Accordingly, the cosmetic product in the body is kept in a good storage condition and protected from deterioration.

Moreover, the outer diameter of the body 51 is smaller than the internal diameter of the positioning ring 43. When the cosmetic product is used up, the bottle 50 can be easily removed from the driving assembly 1 for replacement.

Accordingly, the cosmetic container can be operated conveniently with a single hand of a user. The first sleeve 10 is rotated to drive the driving assembly 1, and then the driving assembly 1 drives the bottle 50 to move upward and downward. Therefore, the cosmetic container is easy to operate. Moreover, the vacuum suction generated from the vacuum valve 54 drives the piston 53 to move upward, and the piston 53 pushes the cosmetic product out of the outlet 56 effectively. Therefore, the quantity of the cosmetic product remaining on the inner surface of the body 51 is decreased. Furthermore, the outer diameter of the body 51 is smaller than the internal diameter of the positioning ring 43. Therefore, the bottle 50 is easy to be changed for replacement.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cosmetic container comprising:

a first sleeve;

a driving assembly mounted in the first sleeve and having a first rotating tube coactively mounted in the first sleeve and having an outer surface;

an inner surface;

an annular flange formed on the outer surface of the first rotating tube;

multiple chutes formed through the outer surface of the first rotating tube and each chute having a slanting section; and a transverse section connected to a top end of the slanting section; and multiple ribs formed on the inner surface of the first rotating tube;

a seat moveably mounted in the first rotating tube and having an outer surface;

multiple protrusions respectively protruding into the chutes of the first rotating tube; and multiple positioning members mounted on the outer surface of the seat and respectively connected to the ribs of the first rotating tube; and a second rotating tube rotatably mounted around the first rotating tube and having an inner surface;

an annular groove formed in the inner surface of the second rotating tube and connected to the annular flange of the first rotating tube;

multiple longitudinal grooves formed in the inner surface of the second rotating tube and the protrusions of the seat respectively protruding into the longitudinal grooves; and a positioning ring formed on the inner surface of the second rotating tube and an internal diameter of the positioning ring being smaller than an internal diameter of the second rotating tube, and the positioning ring having a positioning surface formed on a top surface of the positioning ring;

a bottle mounted in the seat of the driving assembly and having a body mounted in the seat of the driving assembly and an outer diameter of the body being smaller than the internal diameter of the positioning ring;

a chamber formed in the body;

a piston mounted in the body and moveably located in the chamber;

a vacuum valve mounted on the body;

a cap mounted on the vacuum valve and a bottom surface of the cap facing the positioning surface of the positioning ring; and an outlet formed in the cap and sunk in the second rotating tube; and a second sleeve coactively mounted on the second rotating tube of the driving assembly.

2. The cosmetic container as claimed in claim 1, wherein the bottle has a mark mounted on a top surface of the cap to indicate the outlet of the bottle.

3. The cosmetic container as claimed in claim 1, wherein one of the chutes of the first rotating tube has a longitudinal section connected to the transverse section of said chute.

4. The cosmetic container as claimed in claim 2, wherein one of the chutes of the first rotating tube has a longitudinal section connected to the transverse section of said chute.

5. The cosmetic container as claimed in claim 1, wherein the bottle has a recess formed in an outer surface of the cap and located below the outlet.

6. The cosmetic container as claimed in claim 2, wherein the bottle has a recess formed in an outer surface of the cap and located below the outlet.

7. The cosmetic container as claimed in claim 3, wherein the bottle has a recess formed in an outer surface of the cap and located below the outlet.

8. The cosmetic container as claimed in claim 4, wherein the bottle has a recess formed in an outer surface of the cap and located below the outlet.

* * * * *